US007497545B2

(12) United States Patent
Shimizu

(10) Patent No.: US 7,497,545 B2
(45) Date of Patent: Mar. 3, 2009

(54) IMAGE FORMING APPARATUS

(75) Inventor: Masanobu Shimizu, Hachioji (JP)

(73) Assignee: Olympus Corporation, Tokyo (JP)

( * ) Notice: Subject to any disclaimer, the term of this patent is extended or adjusted under 35 U.S.C. 154(b) by 410 days.

(21) Appl. No.: 11/397,152

(22) Filed: Apr. 4, 2006

(65) Prior Publication Data

US 2006/0274108 A1 Dec. 7, 2006

(30) Foreign Application Priority Data

Apr. 6, 2005 (JP) ..... 2005-109902

(51) Int. Cl.
*B41J 2/165* (2006.01)
*B41J 2/01* (2006.01)

(52) U.S. Cl. ..... 347/22; 347/29; 347/30; 347/32; 347/33; 347/104

(58) Field of Classification Search ..... 347/24, 347/29, 30, 32, 33, 104, 22
See application file for complete search history.

(56) References Cited

U.S. PATENT DOCUMENTS 7,083,274 B2 * 8/2006 Morita et al. ..... 347/104
7,281,781 B2 * 10/2007 Okawa ..... 347/32

FOREIGN PATENT DOCUMENTS

JP 2005-22182 A 1/2005

* cited by examiner

*Primary Examiner*—Shih-wen Hsieh
(74) *Attorney, Agent, or Firm*—Frishauf, Holtz, Goodman & Chick, P.C.

(57) ABSTRACT

There is disclosed a compact and inexpensive image forming apparatus which includes a head for discharging inks, an ink supply path fixed in parallel to the head to supply the inks to the head, a recording medium conveying section arranged to face the head, thereby conveying a recording medium, and a maintenance mechanism arranged above the recording medium conveying section and below the ink supply path to perform maintenance of the head during image nonformation.

5 Claims, 13 Drawing Sheets

IMAGE FORMING APPARATUS

CROSS-REFERENCE TO RELATED APPLICATIONS

This application is based upon and claims the benefit of priority from prior Japanese Patent Application No. 2005-109902, filed Apr. 6, 2005, the entire contents of which are incorporated herein by reference.

BACKGROUND OF THE INVENTION

1. Field of the Invention

The present invention relates to an image forming apparatus which has a maintenance mechanism.

2. Description of the Related Art

In a conventional image forming apparatus of an ink jet system, for example, a recording medium such as recording paper or an OHP sheet is conveyed by a recording medium conveying section. When the recording medium is conveyed, inks are discharged from a plurality of nozzles disposed in a recording head to the recording medium. As is well known, a high-quality image is accordingly formed at a high speed.

In such an image forming apparatus, recording media comes into contact with each other during their conveyance to generate dust such as paper particles. This dust sticks to an ink discharge port of a recording head to cause ink clogging. Bubbles may even enter from the ink discharge port to break ink surface tension. These may cause an ink discharging failure to bend an ink discharging direction.

Thus, a maintenance mechanism has conventionally been essential to quickly eliminate the aforementioned causes together with a recording system such as an ink jet system.

As recording systems, there are available a system of performing recording while moving both of a recording head and a recording medium, and a line head system which has, e.g., a recoding head fixed to a line head, and conveys a recording medium only to perform recording.

In the case of the former recording system, the recording head is small, and a maintenance mechanism is small.

However, in the case of the latter line head system, a length of the recording head must be equal to a width of the recording medium, and a maintenance mechanism becomes large when a recording head of plural colors is disposed. In a position facing the recording head, a recording medium conveying section for conveying the recording medium is disposed. Accordingly, the maintenance mechanism must retreat from the position facing the recording head during recording.

As retreating mechanisms, for example, there are known a method of retreating a maintenance mechanism in a direction orthogonal to a recording medium conveying direction with respect to a recording head group in which recording heads of plural colors are arrayed, and a method of retreating a maintenance mechanism below a recording medium conveying section during recording, and sliding the recording medium conveying section during maintenance.

Jpn. Pat. Appln. KOKAI Publication No. 2005-022182 discloses an example of such a retreating mechanism. An ink jet printer shown in FIG. 18A includes a recording medium conveying mechanism 120 for conveying a recording medium (not shown), an ink jet head 112 for discharging an ink to the recording medium conveyed by the recording medium conveying mechanism 120 to form a desired image, a maintenance unit 140 for performing a recovery operation for the ink jet head 112, a retreating mechanism (not shown) for sliding (horizontally moving) the recording medium conveying mechanism 120 to retreat from a space between the ink jet head 112 and the maintenance unit 140 during the recovery operation as shown in FIG. 18B, and a moving mechanism (not shown) for moving at least one of the ink jet head 112 and the maintenance unit 140 for performing the recovery operation to a recovery operation position.

However, according to the aforementioned mechanism, as shown in FIGS. 18B to 18D, the recording medium conveying mechanism 120 must move in the recording medium conveying direction, i.e., in the horizontal direction. Thus, a space equal to or larger than a size of the recording medium conveying mechanism 120 is necessary in the recording medium conveying direction. As a result, an apparatus becomes a large and expensive mechanism.

BRIEF SUMMARY OF THE INVENTION

According to an aspect of the present invention, an image forming apparatus comprises an ink jet recording head including a nozzle plate having a plurality of nozzles arranged in a line to discharge inks to a recording medium, thereby forming an image, the nozzle plate being fixed to an image forming position; an ink supply path fixed in parallel to an arraying direction of the nozzles of the ink jet recording head to supply the inks to the nozzles; a recording medium conveying section arranged to face ink discharge ports of the nozzles of the ink jet recording head, and to convey the recording medium; and a maintenance mechanism arranged above the recording medium conveying section and below the ink supply path to come into contact with the nozzle plate during image nonformation, thereby performing maintenance.

The present invention provides a compact image forming apparatus equipped with a maintenance mechanism by storing the maintenance mechanism below an ink supply path for supplying an ink to an ink jet recording head.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The preferred embodiments of the present invention will be described below in detail with reference to the accompanying drawings.

In description of each embodiment below, throughout the drawings, a conveying direction of a recording medium 60 is an X axis direction or a subscanning direction, and a direction orthogonal to the conveying direction is a Y axis direction, a main scanning direction, or a width direction of the recording medium 60. A direction orthogonal to the X and Y axis directions is a Z axis direction or an up-and-down direction.

Figure 1:
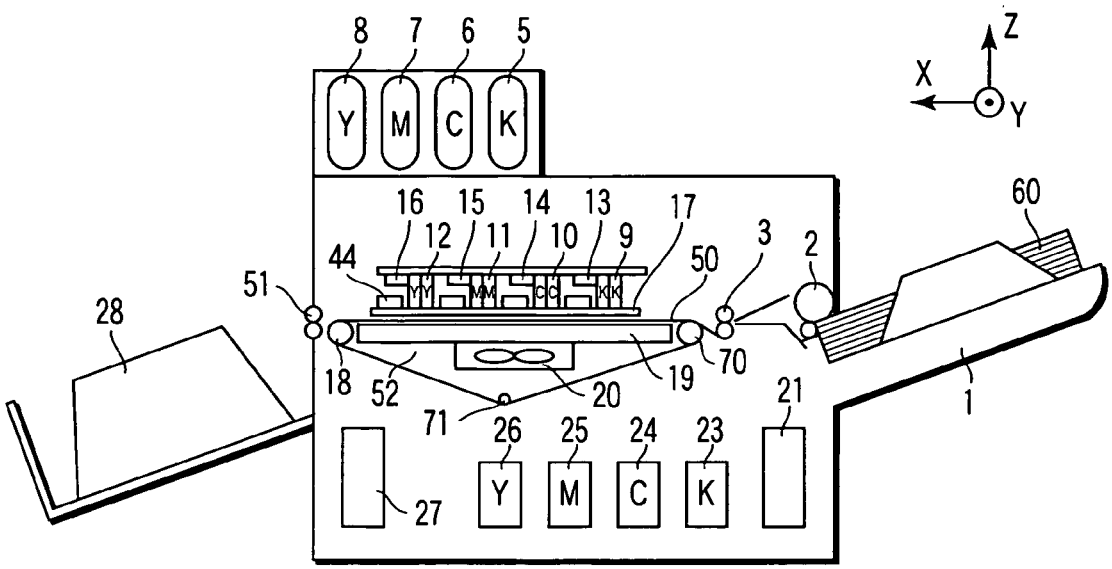
FIG. 1 is a schematic side view of an image forming apparatus according to a first embodiment.
Figure 2:
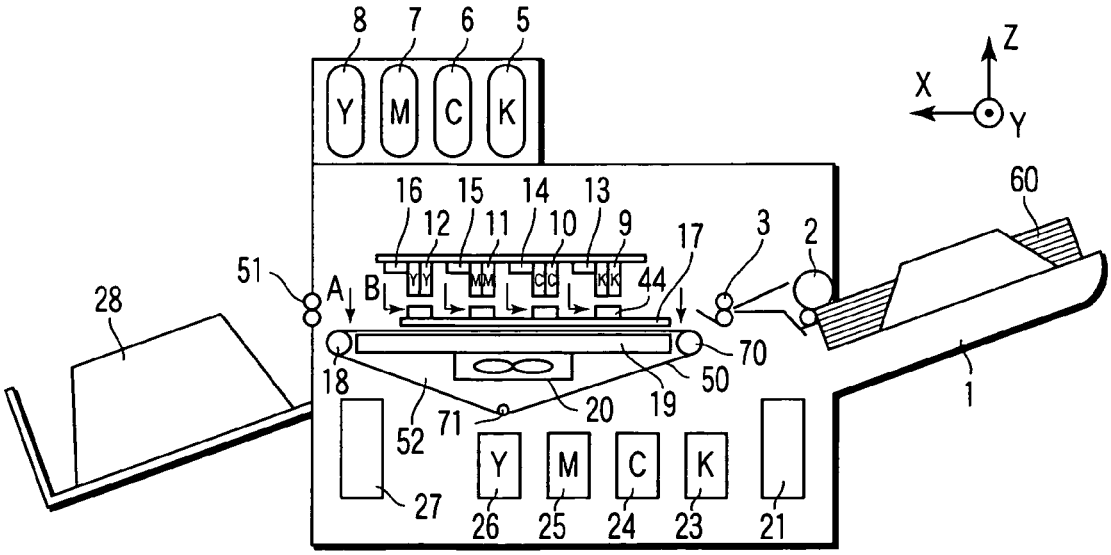
FIG. 2 is a view schematically showing a moving operation of a platen section during maintenance of a recording head.

Referring to FIGS. 1 to 15, a first embodiment of the present invention will be described. FIG. 1 is a schematic side view of an image forming apparatus of the embodiment, and FIG. 2 is a view schematically showing a moving operation of a platen section during maintenance of a recording head.

Figure 3:
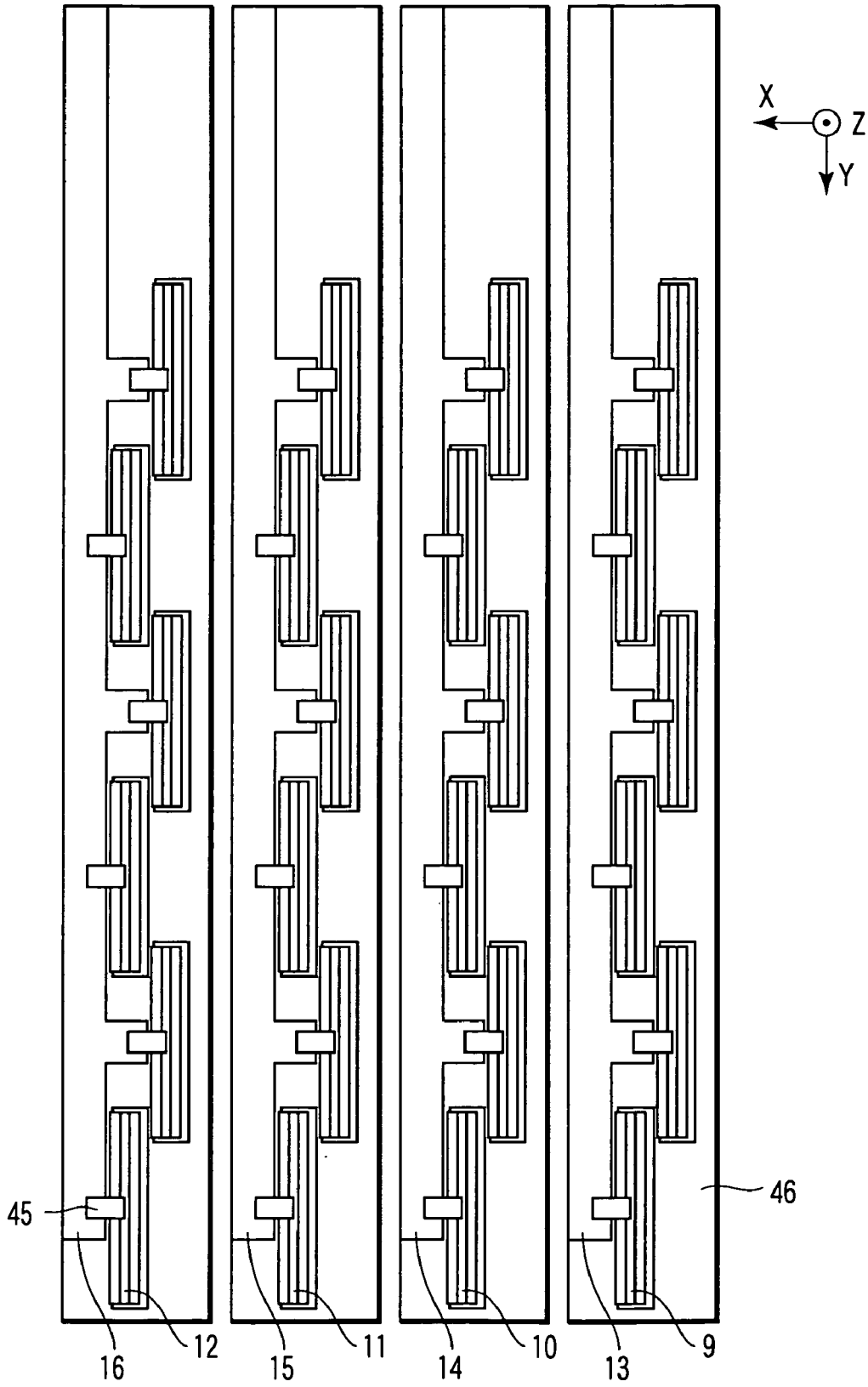
FIG. 3 is a top view showing an arrangement relation between the head and an ink supply path.

First, an outline of the image forming apparatus will be given by referring to FIGS. 1 to 3.

The apparatus includes a feeding section for feeding the recoding medium 60 downstream, a recording medium conveying section which is a belt platen unit 52 arranged on a downstream side of the feeding section to suck and convey the recording medium 60, a recording section arranged to face the recording medium conveying section and to discharge an ink from a discharge port to the recording medium 60 thereby forming an image, and a discharge section for discharging the recording medium 60.

The feeding section includes a feeding base 1 for receiving the recording medium 60, a pickup roller 2 brought into contact with the recording medium 60 received in the feeding base 1 to take out recording media 60 one by one, and a resist roller 3 arranged on a downstream side of the pickup roller 2 to correct tilting of the recording medium 60 in the X axis direction. When the recording medium 60 touches on the resist roller 3, the resist roller 3 aligns the recording medium 60 to correct its tilting in the X axis direction. A longitudinal center axis of the resist roller 3 is arranged to extend in the Y axis direction.

The platen unit 52 (recording medium conveying section) includes a conveyor belt 50 and a platen 19.

The conveyor belt 50 is an endless belt which is hung on a drive roller 18, a follower roller 70, and a tension roller 71 to constitute a belt conveyor, and which has a plurality of small-diameter holes (not shown).

The platen 19 is arranged between the drive roller 18 and the follower roller 70. Many small-diameter holes (not shown) are formed in a recording medium conveying surface of the platen 19. A plurality of suction fans 20 are arranged below the platen 19. When the recording medium 60 is conveyed on the conveyor belt 50, the suction fan 20 sucks it by negative pressure through the plurality of small-diameter holes (not shown) formed in the conveyor belt 50 and many small-diameter holes (not shown) formed in the recording medium conveying surface of the platen 19. Accordingly, the recording medium 60 conveyed from the feeding section is adsorbed on the conveyor belt 50, and conveyed associatively with a movement of the conveyor belt 50 made by rotating the drive roller 18.

The recording section arranged to face the recording medium conveying section includes K, C, M and Y ink bottles 5 to 8 filled with a plurality of inks, e.g., black (K), cyan (C), magenta (M), and yellow (Y), a first tube (not shown) having one end communicated with the bottles, K, C, M and Y subtanks 23 to 26 communicated with the other end of the first tube, a second tube (not shown) having one end communicated with the subtanks, ink supply paths 13 to 16 connected to the other end of the second tube, and a plurality of heads 9 to 12 communicated with the ink supply paths 13 to 16 to discharge color inks thereby forming an image. The ink supply paths 13 to 16 and the heads 9 to 12 are connected together through joints 45. According to the embodiment, the ink supply paths 13 to 16 are ink flow paths arranged near the heads 9 to 12 when inks are supplied to the heads 9 to 12 (detailed arrangement relation between the heads 9 to 12 and the ink supply paths 13 to 16 will be described by referring to FIG. 3).

The discharge section arranged on the downstream side of the recording medium conveying section includes a discharge roller 51 for conveying a formed recording medium, and a stocker 28.

Next, referring to FIG. 3, an arrangement relation between the head and the ink supply path of the embodiment will be described.

The embodiment employs a line head type in which the heads 9 to 12 are fixed without moving arranged positions with respect to the conveyed recording medium 60 at least during image formation. Six short color heads are alternately arranged to overlap their ends. The heads 9 to 12 are arranged in a direction orthogonal to the conveying direction of the recording medium 60. The heads 9 to 12 are fixed to the ink supply paths 13 to 16 by head holding members 46. The ink supply paths 13 to 16 are arranged in parallel to an arraying direction of the nozzles disposed in the heads 9 to 12 as shown. In other words, as in the case of the heads 9 to 12, the ink supply paths 13 to 16 are arranged in a direction orthogonal to the conveying direction of the recording medium 60.

Taking workability into consideration, the heads 9 to 12 can be attached to/detached from the upside of the ink supply paths 13 to 16.

If the ink supply paths 13 to 16 are arranged above the heads 9 to 12, work efficiently is not improved during head detachment. There is a fear that when the heads 9 to 12 are removed from the ink supply paths 13 to 16, inks may leak from the ink supply paths 13 to 16, and stick to the heads to stain them. Thus, the ink supply paths 13 to 16 are arranged only on the downstream side which is one direction with respect to the recording medium conveying direction. According to the embodiment, the ink supply paths 13 to 16 are arranged on the downstream side of the heads 9 to 12. However, they may be arranged on the upstream side.

As described above, by arranging the ink supply paths 13 to 16 only on one side parallel to the nozzle arraying directions of the heads, a length of a height (Z axis) direction of the entire apparatus can be shortened.

Figure 4A:
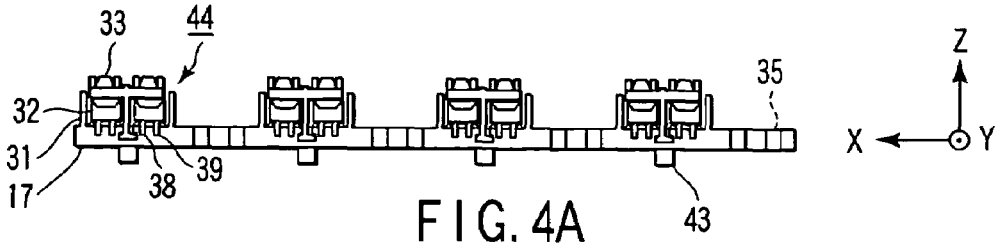
FIG. 4A is a schematic side view showing an arrangement relation of a maintenance mechanism.
Figure 4B:
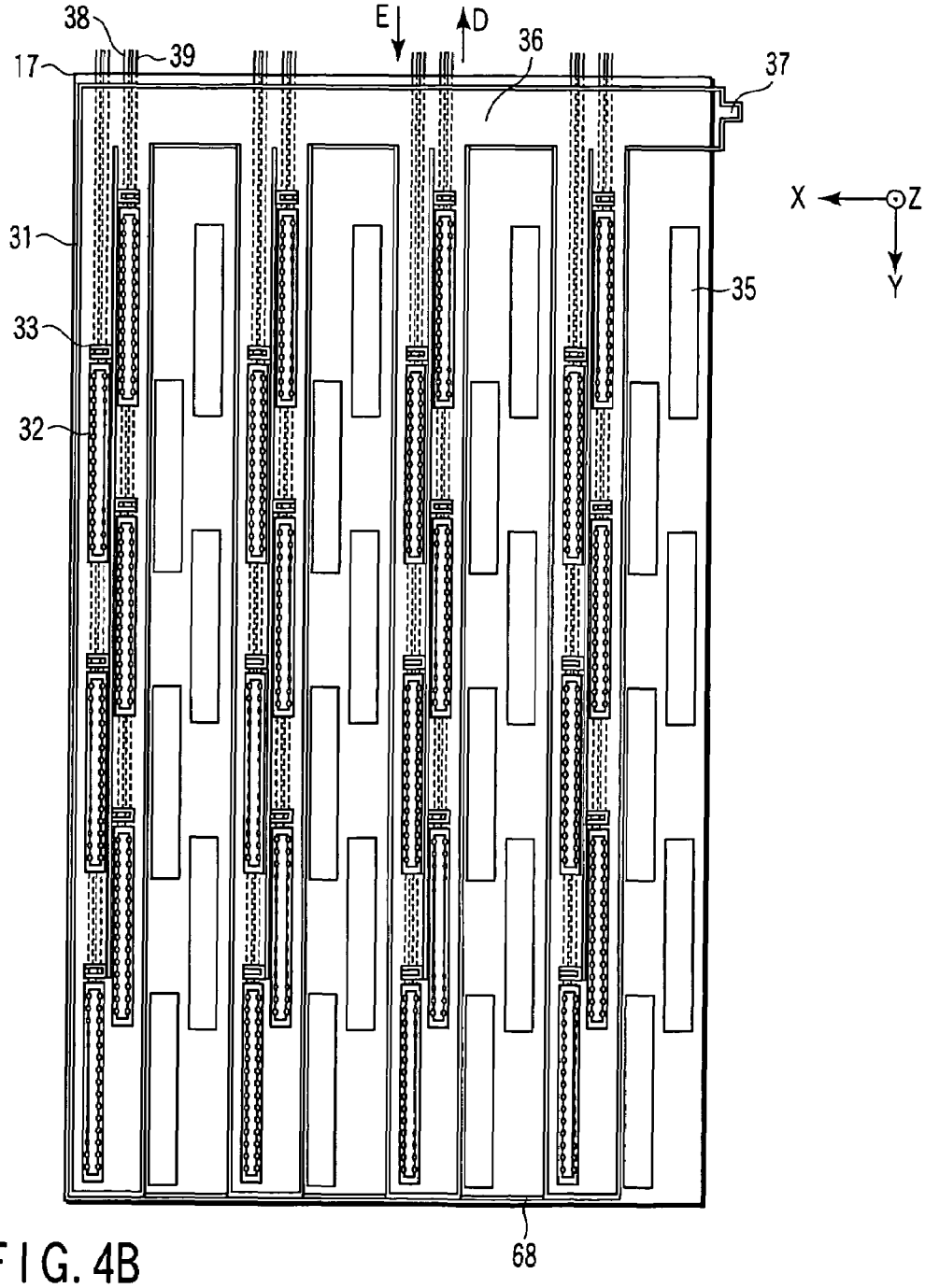
FIG. 4B is a schematic top view showing the arrangement relation of the maintenance mechanism.
Figure 5A:
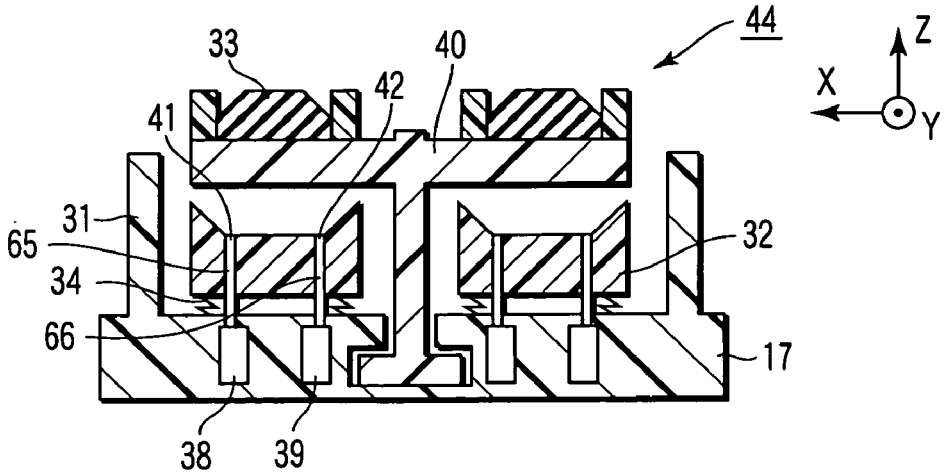
FIG. 5A is a schematic enlarged sectional view showing a portion around the maintenance mechanism.
Figure 5B:
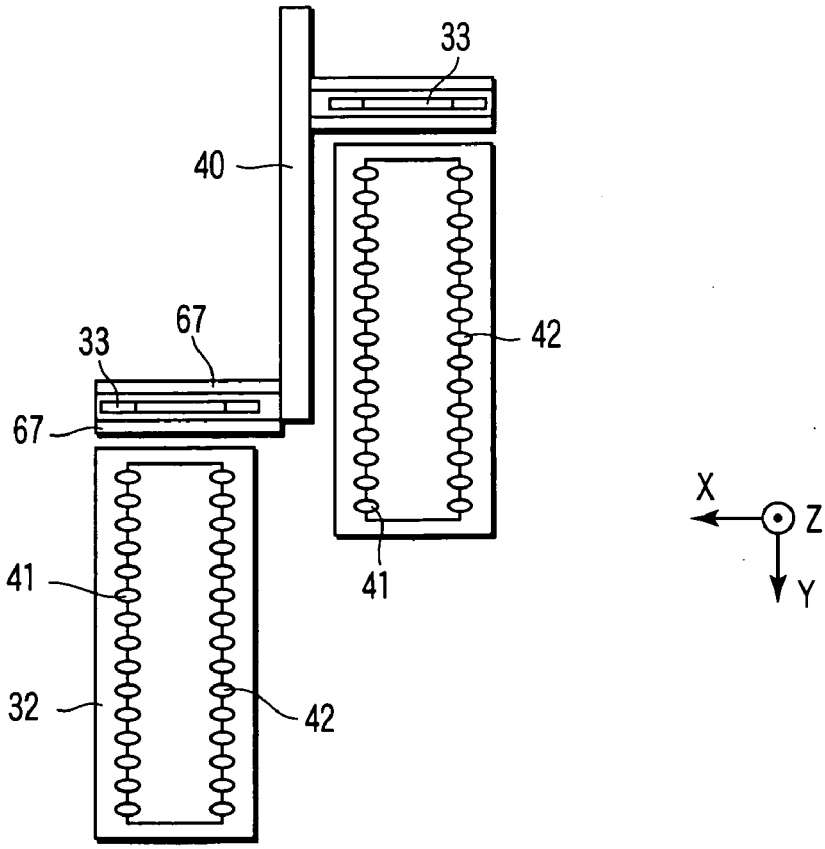
FIG. 5B is a top view showing the portion around the maintenance mechanism.

Next, referring to FIGS. 4A to 5B, the maintenance mechanism of the embodiment will be described in detail. FIG. 4A is a schematic side view showing an arrangement relation of the maintenance mechanism, and FIG. 4B is a schematic top view showing the arrangement relation of the maintenance mechanism. FIG. 5A is a schematic enlarged sectional view of a portion around the maintenance mechanism, and FIG. 5B is a top view of the portion around the maintenance mechanism.

According to the embodiment, to maintain a line head mechanism constituted of six alternately arranged heads, a sucking body 32 and a wipe blade 33 are also alternately arranged. Each component of the maintenance mechanism 44 equipped with the sucking body 32 and the wipe blade 33 will be described below.

The sucking body 32 is supported by a spring 34 to be bonded to each head. This spring is disposed in a maintenance plate 17. The wipe blade 33 is supported by a support 40, and grooves 67 are arranged before and after the wipe blade 33 in the Y axis direction so that inks wiped by the wipe blade 33 can flow through the support 40.

The sucking body 32 is communicated with an air intake groove 38 through an air inlet 42 and a path 65, and with an air suction groove 39 through a path 66 and an air suction port 42. The maintenance mechanism 44 takes in air from the air inlet 41 (flow in a direction of an arrow E), and sucks air from the air suction port 42 (flow in a direction of an arrow D).

An ink pan 31 is a wall surrounding totally twenty four sucking bodies 32 and wipe blades 33. A waste ink left in the wall is discharged through a waste liquid port 37. As it is formed integrally with the maintenance plate 17, the ink pan 31 increases rigidity of the maintenance plate 17 which has a rib function. Moreover, a rib 68 is arranged between the ink pans 31 to increase the rigidity of the maintenance plate 17.

The aforementioned maintenance mechanisms 44 are all arranged on one maintenance plate 17. A slit 35 corresponding to each head is arranged in the maintenance mechanism 44 to prevent the head on the maintenance plate 17 from touching.

The maintenance mechanism 44 causes the head 9 to touch on the sucking body 32, and controls a cutoff mechanism (not shown) to close the paths 65, 66 communicated with the air intake groove 38 and the air suction groove 39, thereby capping them.

Next, a method of conveying a recording medium and a method of forming an image will be described.

The recording medium 60 received on the feeding base 1 is sent by the pickup roller 2, and conveyed to the conveyor belt 50 after its conveying posture is corrected by the resist roller 3. As described above, the plurality of holes (not shown) are formed in the conveyor belt 50, and many small-diameter holes are formed in the recording medium conveying surface of the platen 19. The recording medium 60 is passed through these holes by negative pressure generated by the suction fan 20 to be sucked and adsorbed on the conveyor belt 50. Further, the drive roller 18 rotates the conveyor belt 50 in the sucked and adsorbed state of the recording medium 60, whereby the recording medium 60 is conveyed.

According to the embodiment, four-color heads of K, C, M and Y are arranged in a line. Each head is arranged orthogonally to a recording medium conveying direction to constitute one recording head. When the recording medium 6 is conveyed below ink discharge ports of the K, C, M and Y heads 9 to 12, inks are discharged from the heads to land in the recording medium, whereby an image is formed. Subsequently, the recording medium 60 is passed through a discharge roller 51 to be received in the stocker 28.

Next, a method of supplying an ink to each head during image formation will be described.

During image formation, inks flow through the K, C, M and Y ink bottles 5 to 8 through a first tube (not shown) into the K, C, M and Y subtanks 23 to 26. Then, the inks are supplied through a second tube (not shown) and the K, C, Y and M ink supply paths 13 to 16 and the joint 45 to the K, C, M and Y heads 9 to 12.

Next, referring to FIG. 2 and FIGS. 6 to 9, a maintenance operation will be described.

Figure 6:
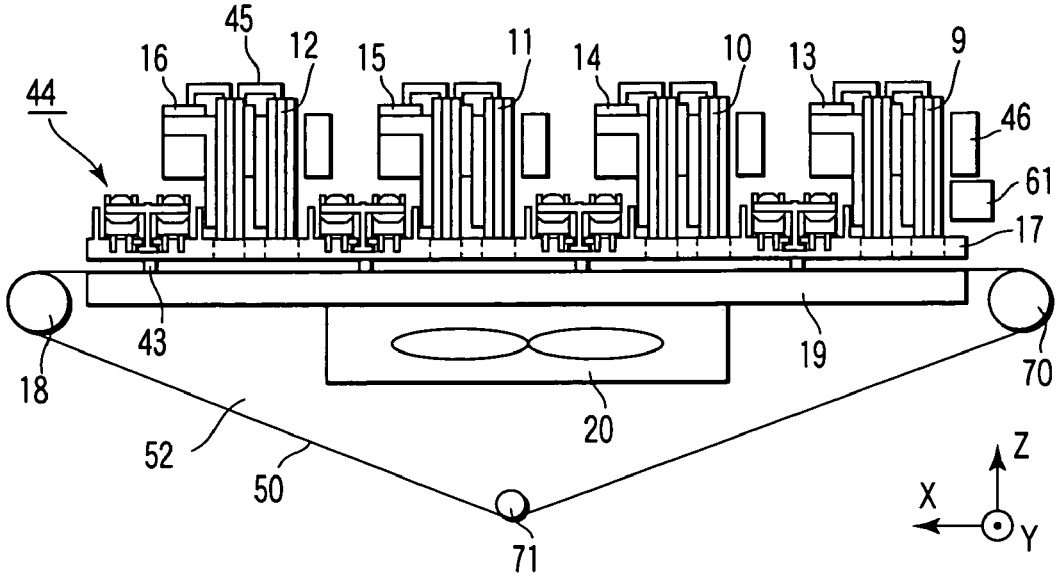
FIG. 6 is a view showing a maintenance operation.

As shown in FIG. 6, the maintenance plate 17 is supported by a plurality of supports 43, and arranged above the belt platen unit 52. In this case, the maintenance mechanism 44 that includes the sucking body 32 and the wipe blade 33 having suction and wiping functions described below is stored in a space below the ink supply paths 13 to 16 near the heads 9 to 12.

Figure 7:
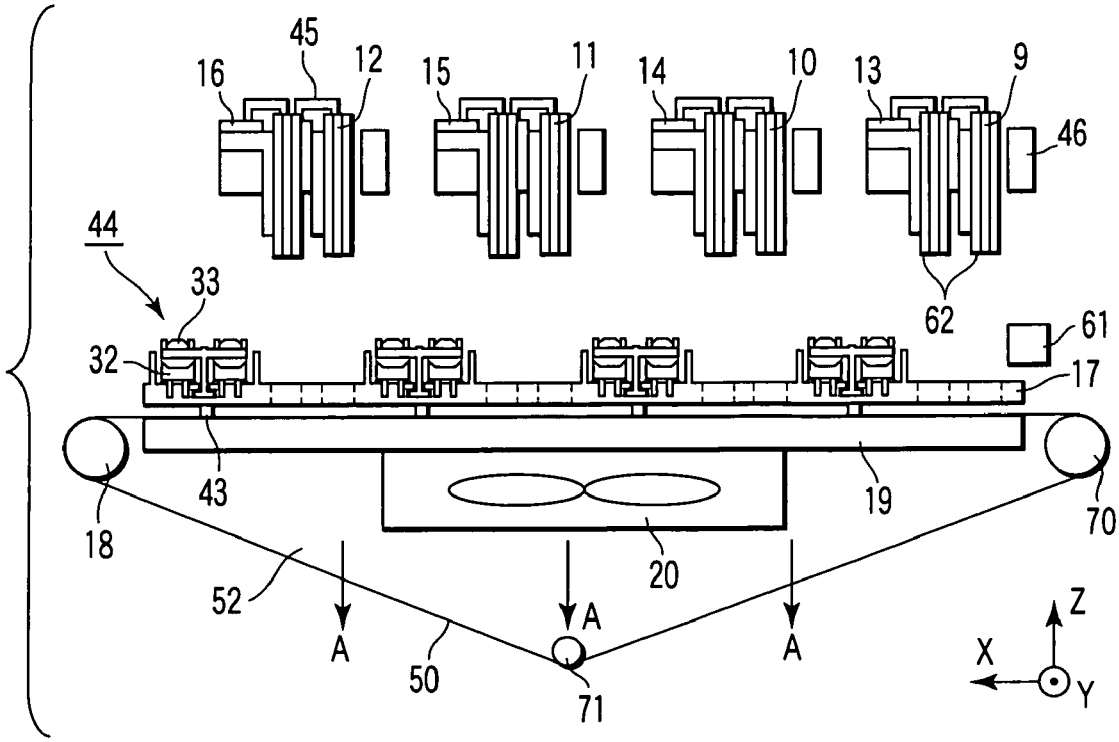
FIG. 7 is a view showing the maintenance operation.

Next, as shown in FIGS. 2 and 7, the belt platen unit 52 comes down in a direction of an arrow A, and the maintenance plate 17 supported by the support 43 corner down associatively with the belt platen unit 52.

Figure 8:
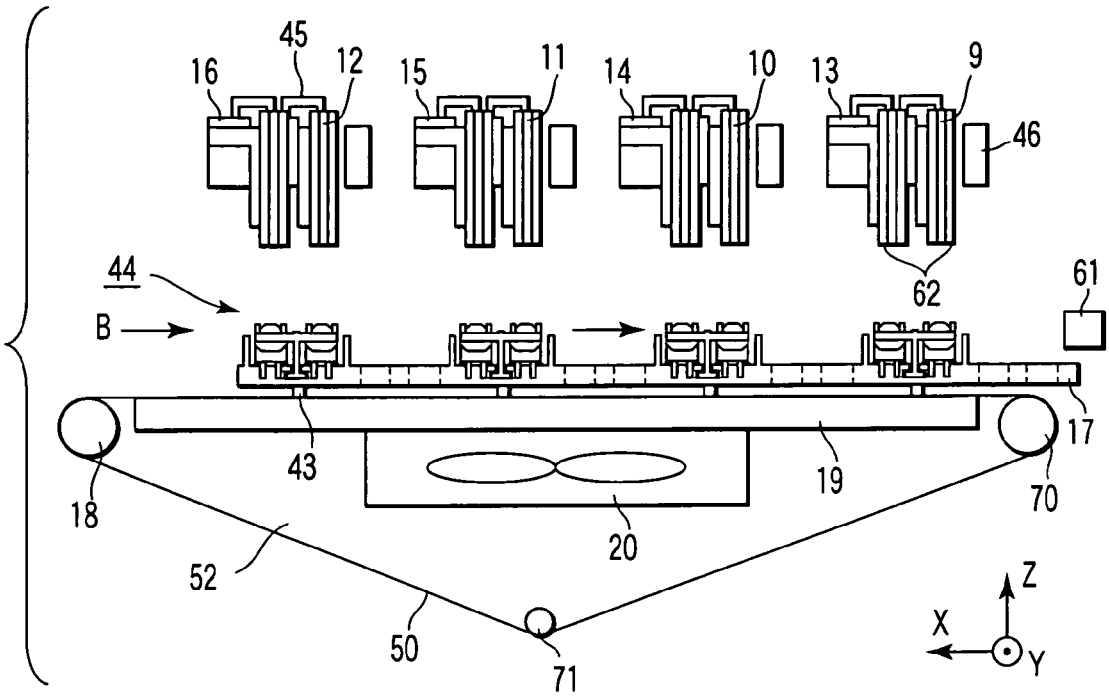
FIG. 8 is a view showing the maintenance operation.

As shown in FIGS. 2 and 8, the maintenance unit 44 disposed in the maintenance plate 17 arranged above the belt platen unit 52 moves in a direction of an arrow B by a drive source 61 up to a position directly below each head.

Figure 9:
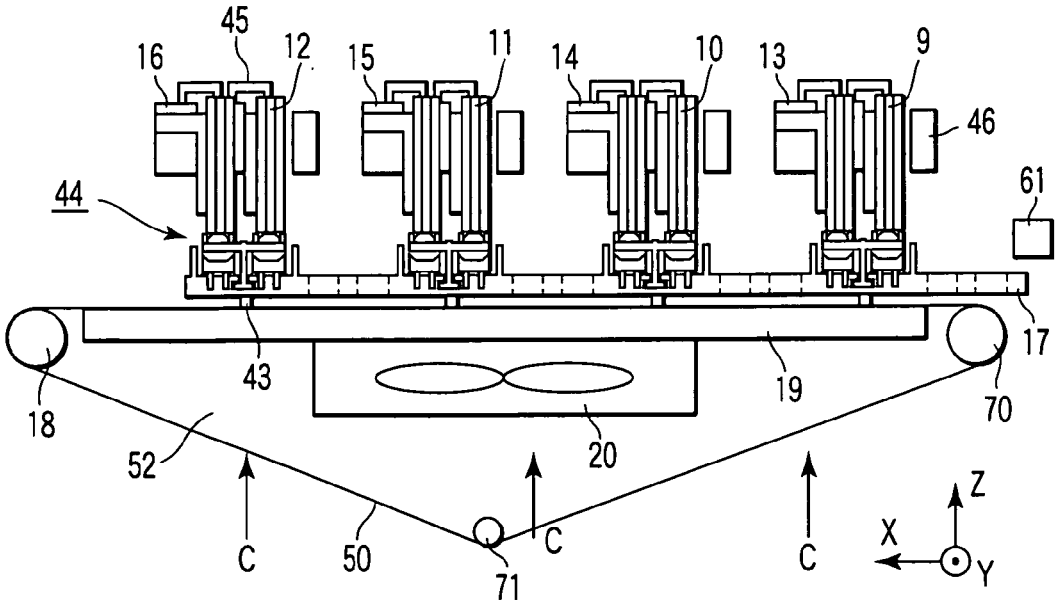
FIG. 9 is a view showing the maintenance operation.

Lastly, as shown in FIG. 9, the belt platen unit 52 rises in a direction of an arrow C, whereby the maintenance mechanism 44 can maintain the heads 9 to 12.

Next, an actual maintenance operation will be described.

In the actual maintenance operation, a pressure source 21 purges each head by pressure to push out an ink from a nozzle surface 62 in a state shown in FIG. 9. The wipe blade 33 wipes off a foreign object stuck to the nozzle surface 62 and the pushed-out ink (wiping operation). Then, the sucking body 32 touches on the nozzle surface 62 of each head, or a mask plate 47 fixed to the nozzle surface 62. In this case, a negative pressure source 27 generates negative pressure, and the ink left in the nozzle surface 62 or the mask plate 47 is sucked from the air inlet 42 (sucking operation). Subsequently, by cutting off the paths 65, 66 communicated with the air intake groove 38 and the air suction groove 39, the maintenance mechanism 44 caps the nozzle surface 62 (capping operation).

Figure 10:
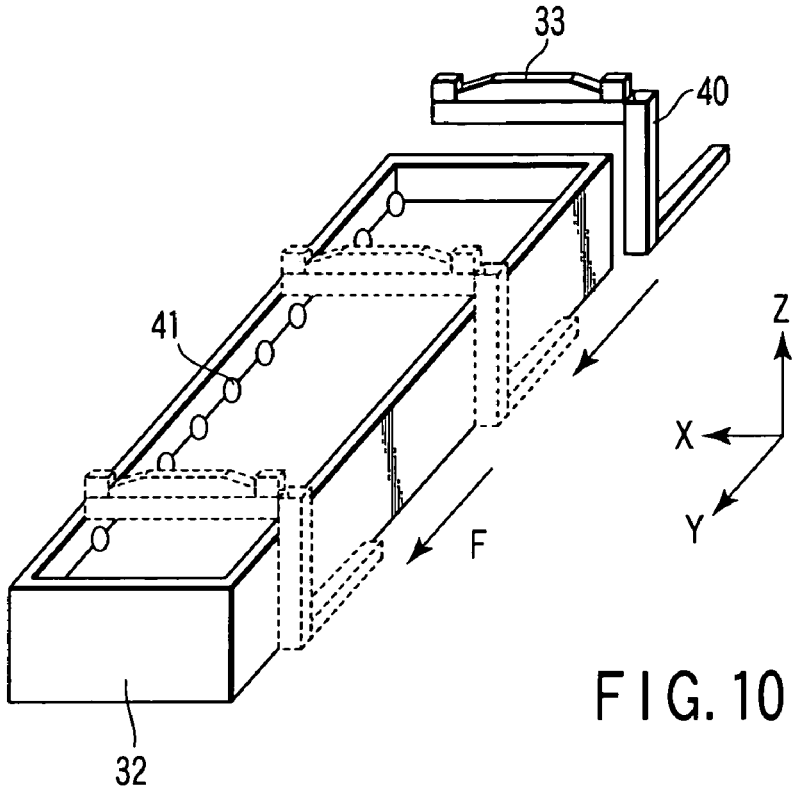
FIG. 10 is a perspective view showing a wiping operation.
Figure 11:
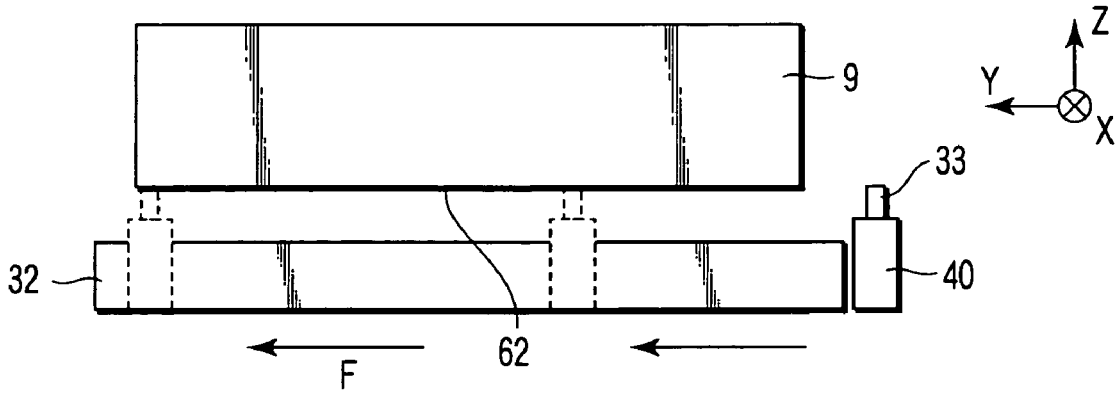
FIG. 11 is a side view showing the wiping operation.

Next, referring to FIGS. 10 and 11, the wiping operation will be described in detail. FIGS. 10 and 11 are respectively a perspective view and a side view showing the wiping operation.

When the belt platen unit 52 rises as shown in FIG. 9, the wipe blade 33 disposed in the maintenance mechanism 44 touches on the nozzle surface 62. As shown in FIGS. 10 and 11, the wipe blade 33 moves between the head 9 and the sucking body 32 (direction of an arrow F (Y axis direction)). The wipe blade 33 wipes off the foreign object and the ink stuck to the nozzle surface 62. The wiped-off ink flows through the grooves 67 formed before and after the wipe blade 33 to the support 40 and the ink pan 31.

Figure 12A:
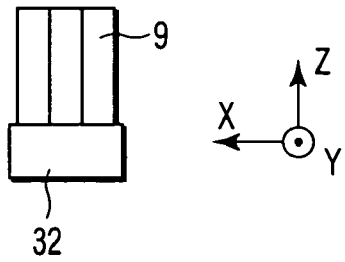
FIG. 12A is a schematic side view showing a state in which a sucking body touches on the head in a Y axis direction.
Figure 12B:
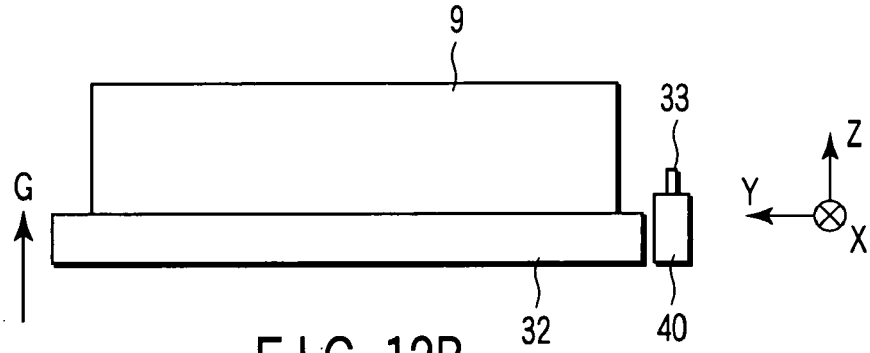
FIG. 12B is a schematic side view showing a state in which the sucking body touches on the head to perform a capping operation in an X axis direction.
Figure 12C:
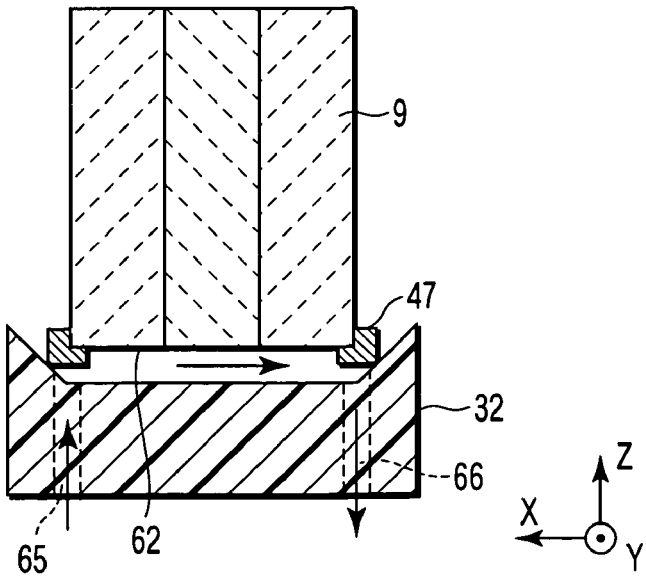
FIG. 12C is a partial schematic sectional view showing a state in which the sucking body touches on the head to perform a capping operation in the Y axis direction.

Next, referring to FIGS. 5A and 5B and FIGS. 12A to 12C, the sucking operation and the capping operation (state in which the sucking body 32 touches on the head 9) will be described. FIG. 12A is a schematic side view in the Y axis direction showing the touched state of the sucking body 32 on the head 9. FIG. 12B is a schematic side view in the X axis direction in which the sucking body 32 touches on the head 9 to perform a capping operation. FIG. 12C is a partial schematic sectional view in the Y axis direction in which the sucking body 32 touches on the head 9 to perform the capping operation.

When the belt platen unit 52 rises as shown in FIG. 9, as shown in FIGS. 12A and 12B, the sucking body 32 disposed in the maintenance mechanism 44 moves in a direction of an arrow G, and touches on the mask plate 47 arranged in the nozzle surface 62 of the head 9 to be bonded. In this case, as shown in FIG. 12C, the nozzle surface 62 is set apart from the sucking body 32 to create a space. During ink suction, air is first sucked from a cap through the path 66, flows in an arrow direction shown in FIG. 12C, and air is taken from the path 65. Simultaneously, an ink is sucked through the path 66. The maintenance mechanism 44 can suck an ink through the path 66 even if the path 65 is cut off by a cutoff mechanism (not shown) (sucking operation).

When the sucking body 32 is bonded to the head 9, the paths 65, 66 communicated with the air intake groove 38 and the air suction groove 39 are cut off to seal a portion near the nozzle surface 62, and the maintenance operation 44 caps the head 9 (capping operation).

Figure 13:
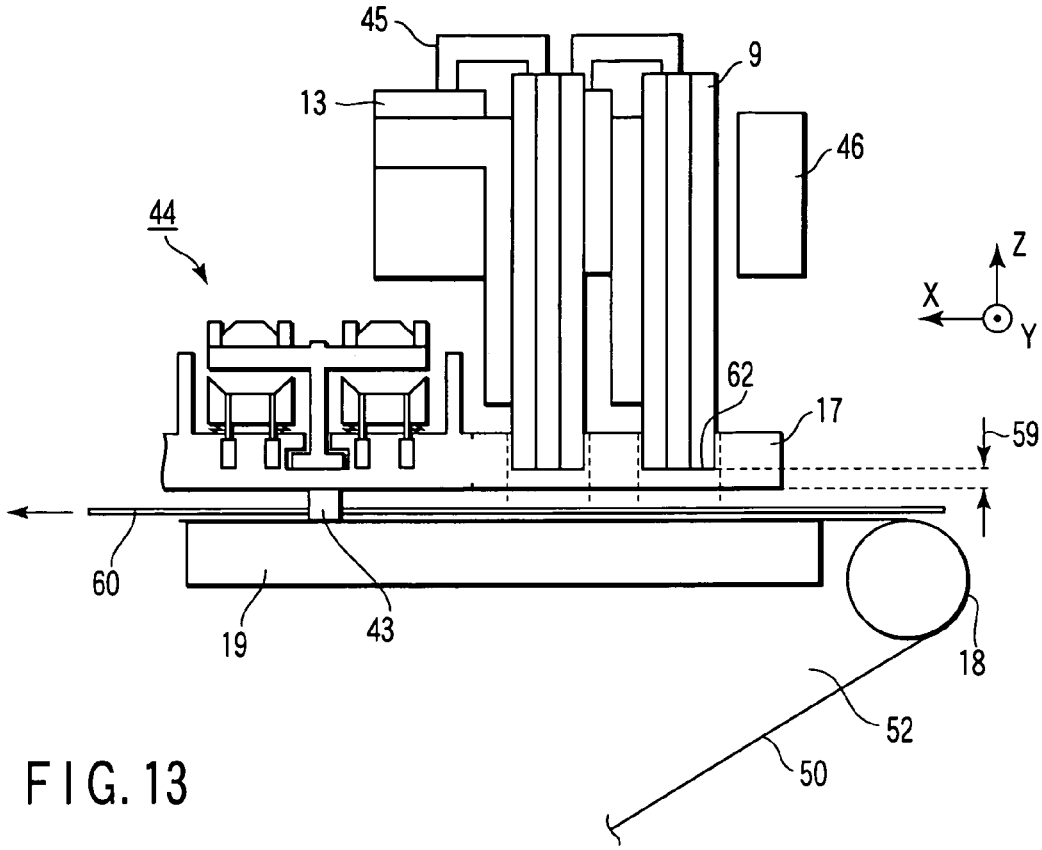
FIG. 13 is a side view showing a portion around a maintenance plate.
Figure 14:
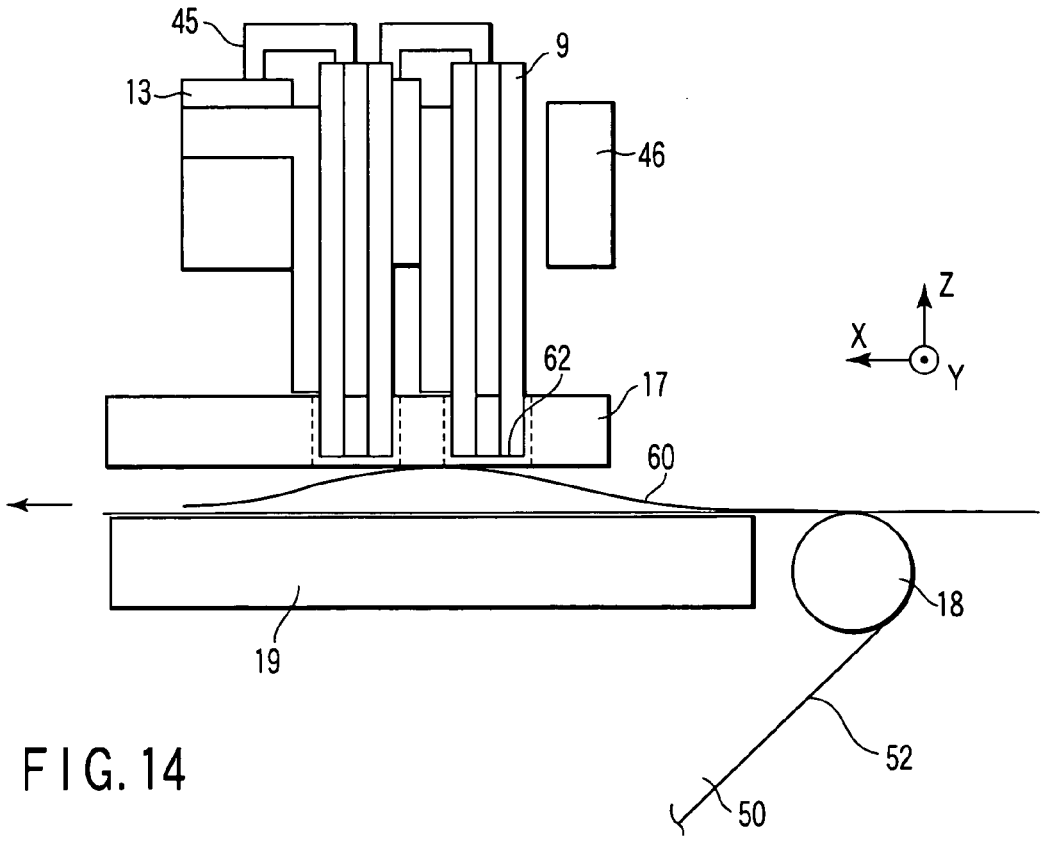
FIG. 14 is a side view showing the portion around the maintenance plate.
Figure 15:
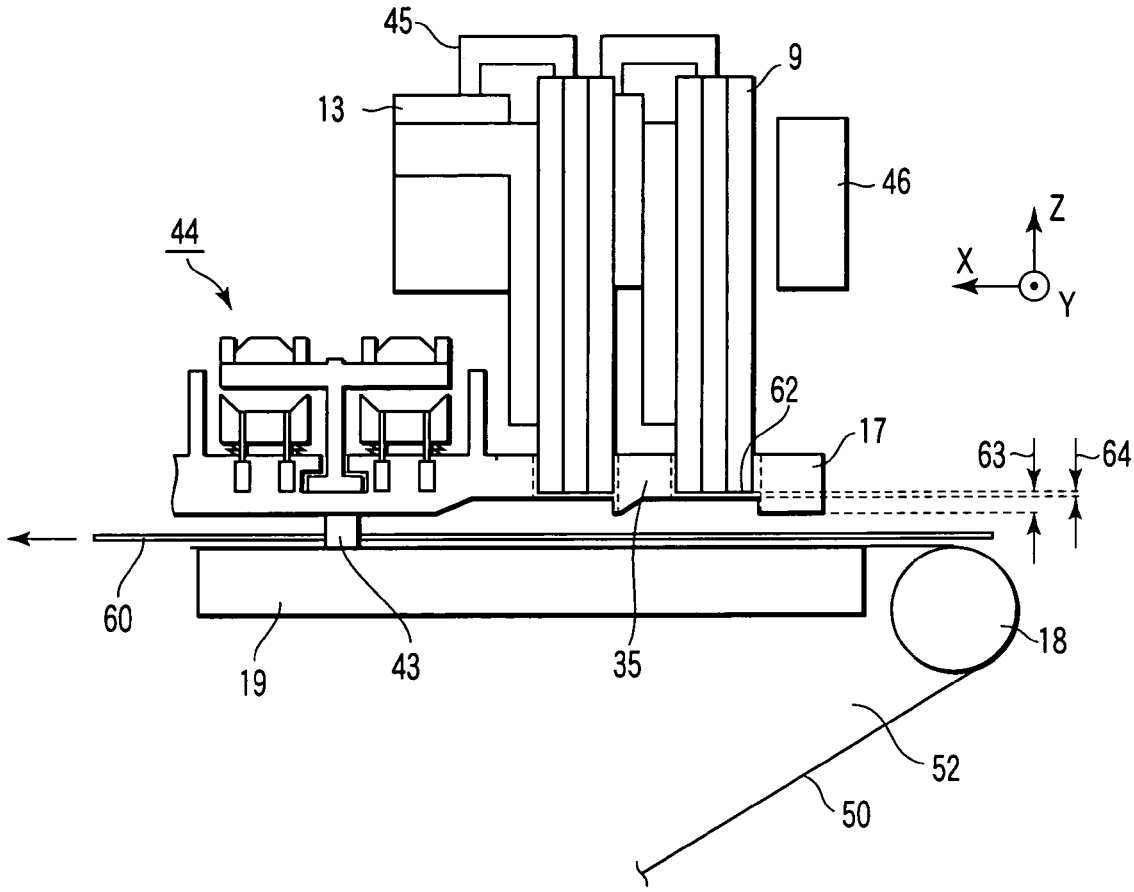
FIG. 15 is a side view showing the portion around the maintenance plate.

FIGS. 13 to 15 are side views of a portion around the maintenance plate 17.

In FIG. 13, a bottom surface of the maintenance place 17 is set in a position lower than the nozzle surface 62, i.e., a position near the belt platen unit 52. According to the embodiment, a gap 59 is generated so that the bottom surface of the maintenance plate 17 can be lower by, e.g., 0.5 mm, than the nozzle surface 62.

Thus, the entire bottom surface of the maintenance plate 17 also serves as a recording medium guide. When the recording medium 60 is conveyed in the arrow direction to form an image, the bottom surface of the maintenance plate 17 approaches the recording medium 60 more than the nozzle surface 62. Accordingly, as shown in FIG. 14, when the recording medium 60 floats from the belt platen unit 52 to be conveyed in the arrow direction, the bottom surface of the maintenance plate 17 can prevent contact of the recording medium 60 with the nozzle surface 62.

As the recording medium 60 conveyed by the belt platen unit 52 does not touch on the nozzle surface 62 of the head 9, the bottom surface of the maintenance plate 17 can always prevent damage of the nozzle surface 62 caused by its contact with the recoding medium 60, and maintain a good state of no discharging or bending failures.

When the recording medium 60 is conveyed in a direction of an arrow, on a conveying-direction upstream side of the bottom surface of the maintenance plate 17, a gap 63 of the conveying-direction upstream side is set to about 0.7 mm from the nozzle surface 62, and a gap 64 of a conveying direction downstream side is set to about 0.5 mm. A distance between the recording medium 60 and the maintenance plate 175 is narrower on a downstream wide of a recording medium conveying direction than on an upstream side. It makes difficult sticking of the recording medium 60, thereby improving feeding performance. According to the embodiment, the gap 59 is 0.5 mm. However, the invention is effective as long as there is a gap of 0.1 mm or more.

As described above, according to the embodiment, the maintenance mechanism 44 that includes the sucking body 32 and the wipe blade 33 having the sucking and wiping functions is arranged on one maintenance plate 17, and stored below the near ink supply paths 13 to 16 for supplying inks to the heads 9 to 12. Hence, the entire apparatus can be miniaturized, and an inexpensive image forming apparatus can be provided.

As the ink pan 31 is formed integrally with one maintenance plate 17, the ink pan 31 serves as a rib function to provide high rigidity. Besides, the maintenance mechanism 44 can be reduced in thickness by providing the wiping and capping functions, whereby a good image of no discharging or bending failures can be formed.

As the maintenance plate 17 moves associatively with the belt platen unit 52, a drive source only for a rising movement is made unnecessary, and a compact and inexpensive image forming apparatus can be provided.

Furthermore, as the entire bottom surface of the maintenance plate 17 also serves as a recording medium guide, the apparatus can be maintained in a good state without being enlarged or without damaging the head.

Figure 16:
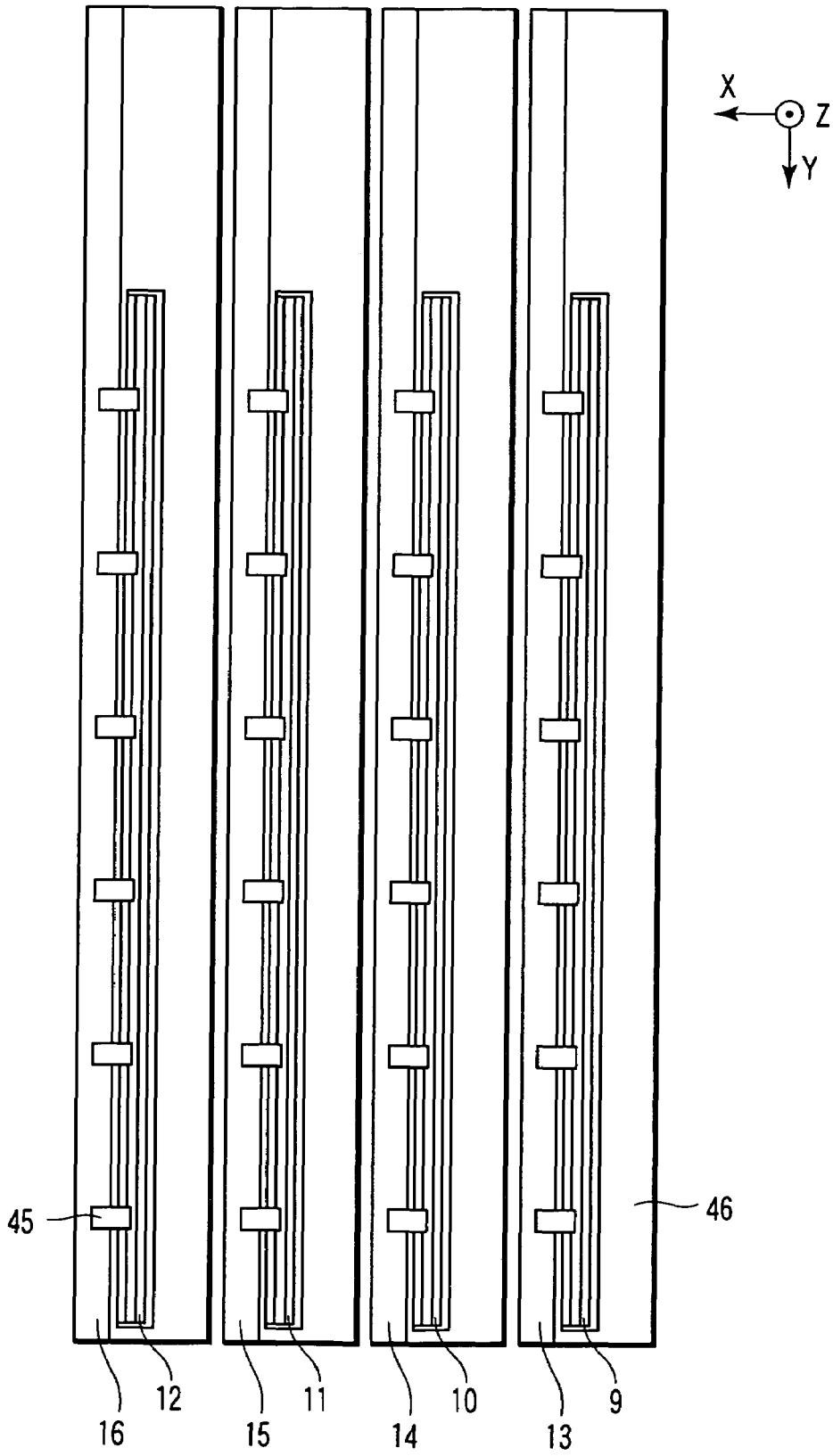
FIG. 16 is a top view showing an arrangement relation between a head and an ink supply path of an image forming apparatus according to a second embodiment.
Figure 17A:
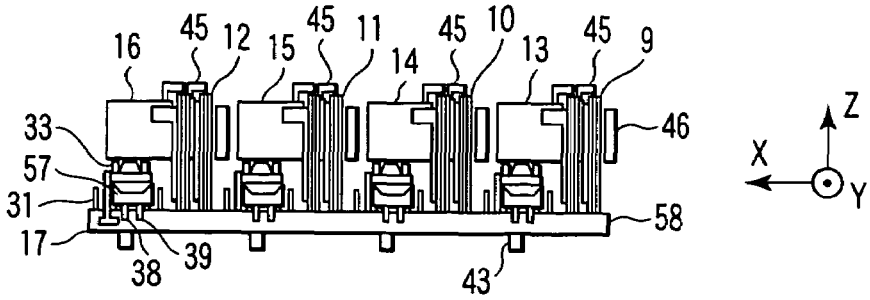
FIG. 17A is a schematic sectional side view showing the head, the ink supply path, and a portion around a maintenance mechanism.
Figure 17B:
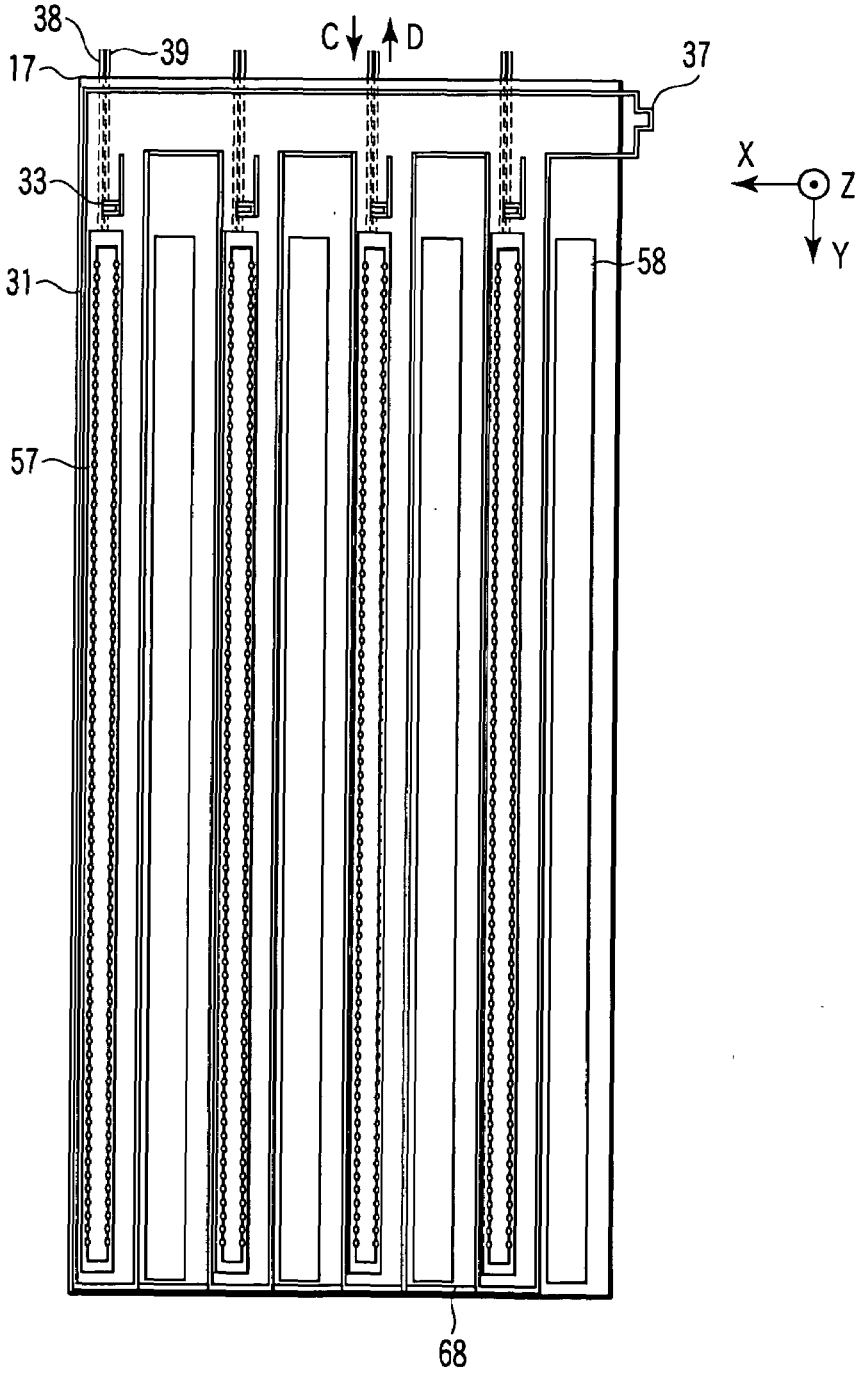
FIG. 17B is a schematic top view of a portion showing the arrangement relation of the maintenance mechanism.
Figure 18A:
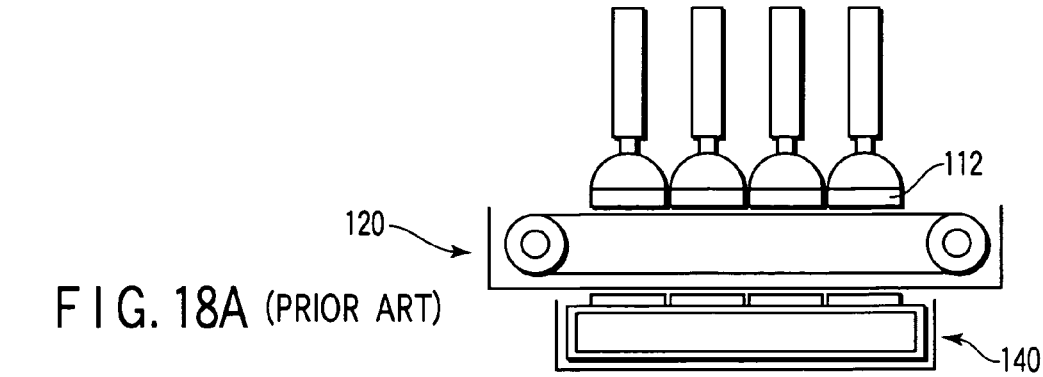
FIG. 18A (PRIOR ART)
FIG. 18A is a view showing a maintenance operation of a conventional image forming apparatus.
Figure 18B:
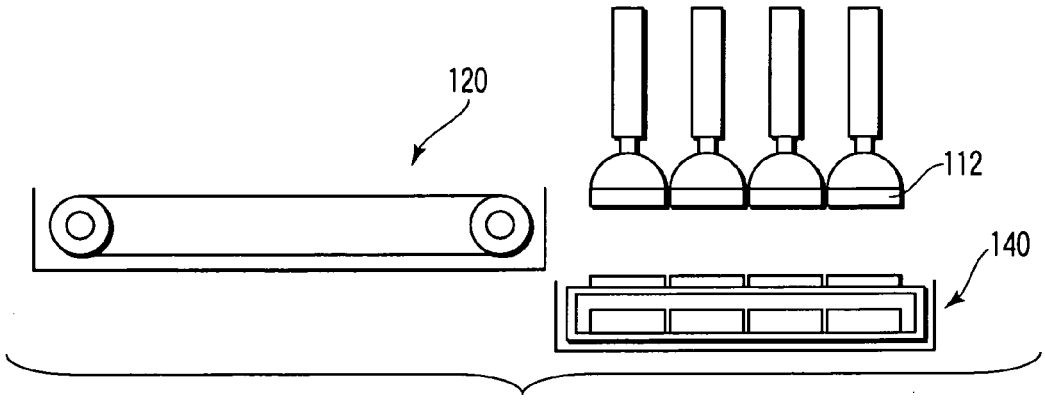
FIG. 18B (PRIOR ART)
FIG. 18B is a view showing the maintenance operation of the conventional image forming apparatus.
Figure 18C:
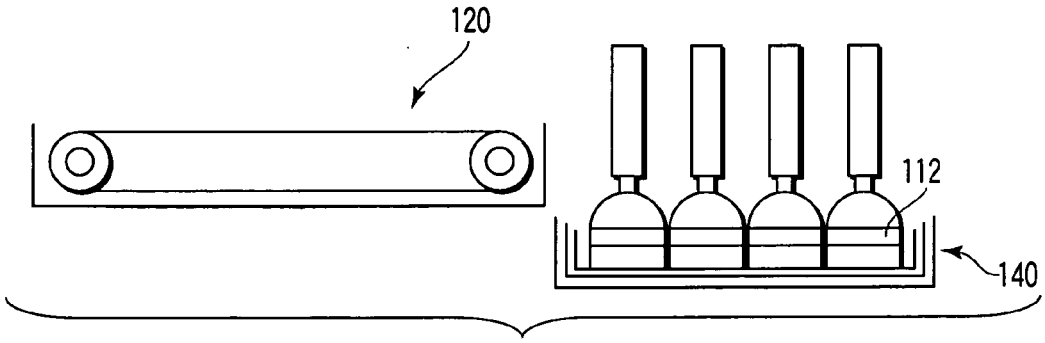
FIG. 18C (PRIOR ART)
FIG. 18C is a view showing the maintenance operation of the conventional image forming apparatus.
Figure 18D:
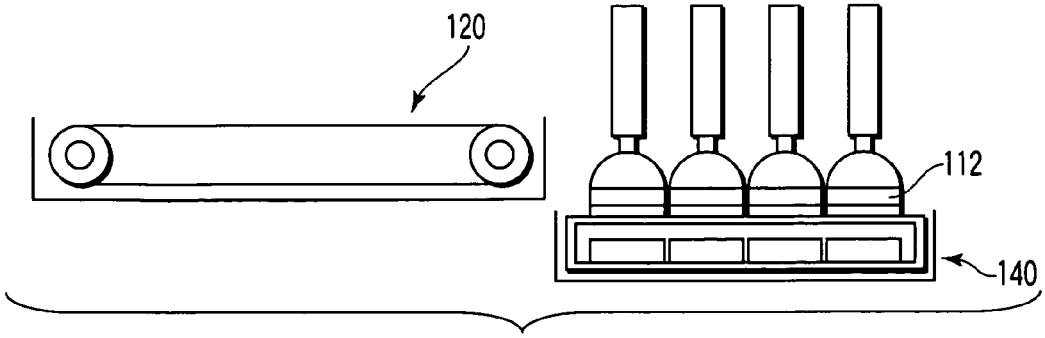
FIG. 18D (PRIOR ART)
FIG. 18D is a view showing the maintenance operation of the conventional image forming apparatus.

Next, referring to FIG. 16 and FIGS. 17A and 17B, a second embodiment of the present invention will be described in detail. Sections similar to those of the first embodiment will be denoted by similar reference numerals, and detailed description thereof will be omitted. FIG. 16 is a top view showing an arrangement relation between a head and an ink supply path of the embodiment. FIG. 17A is a schematic sectional side view showing a portion around a maintenance mechanism. FIG. 17B is a schematic top view of a portion showing the arrangement relation of the maintenance mechanism.

According to the embodiment, a group of four-color line heads is arranged in a head holding member also serving as a heat radiation member 48. Each head of the embodiment is a long line head long in a recording medium width direction. Heads 9 to 12 are arranged in a direction orthogonal to a conveying direction of the recording medium 60. Thus, according to the embodiment, ink supply paths 13 to 16 for supplying inks are arranged beside the heads by considering pressure losses of flow paths. The ink supply paths 13 to 16 are arranged in parallel to an arraying direction of nozzles disposed in the heads 9 to 12 as shown. To make head discharge characteristics uniform, six joints 45 for supplying inks to the heads are disposed. According to the embodiment, as in the case of the first embodiment, the ink supply paths 13 to 16 constitute ink flow paths arranged near the heads 9 to 12 when inks are supplied to the heads 9 to 12.

According to the embodiment, as each line head is constituted of one head, a sucking body 57 is also constituted of one as shown in FIGS. 17A and 17B. A slit 58 is formed to prevent the head on a maintenance plate 17 from touching. One slit 59 is provided corresponding to each head.

Each line head is constituted of one head over a recording medium width. When a recording medium 60 is conveyed below the K, C, M and Y heads 9 to 12, inks are discharged from the heads, and land in the recording medium 60 to form an image.

According to the embodiment, in the image forming apparatus of a type in which an ink of one color is discharged from one head, the maintenance mechanism is stored below the ink supply paths 13 to 16. Hence, the entire apparatus can be miniaturized, and an inexpensive image forming apparatus can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An image forming apparatus comprising:

an ink jet recording head including a nozzle plate which has a plurality of nozzles to discharge ink to a recording medium arranged in a line;

an ink supply path which supplies the ink to the ink jet recording head;

a recording medium conveying section arranged to face the nozzles of the ink jet recording head, and to convey the recording medium; and a maintenance mechanism which is arranged on a maintenance plate arranged above the recording medium conveying section to come into contact with or approach the nozzle plate during image nonformation, thereby performing maintenance;

wherein the maintenance plate includes an ink pan rib.

2. The image forming apparatus according to claim 1, wherein the ink pan rib has a wall surrounding the maintenance mechanism.

3. An image forming apparatus comprising:

an ink jet recording head including a nozzle plate which has a plurality of nozzles to discharge ink to a recording medium arranged in a line;

an ink supply path which supplies the ink to the ink jet recording head;

a recording medium conveying section arranged to face the nozzles of the ink jet recording head, and to convey the recording medium; and a maintenance mechanism which is arranged on a maintenance plate arranged above the recording medium conveying section to come into contact with or approach the nozzle plate during image nonformation, thereby performing maintenance;

wherein the maintenance plate guides the recording medium which is conveyed by the recording medium conveying section, and makes a distance between the maintenance plate and the recording medium which is conveyed by the recording medium conveying section narrower on a downstream side of a recording medium conveying direction than on an upstream side during image formation.

4. The image forming apparatus according to claim 3, wherein the maintenance plate is closer to the recording medium than the nozzle plate during image formation.

5. The image forming apparatus according to claim 3, wherein the maintenance mechanism is associated with the recording medium conveying section during maintenance.

* * * * *